US006382524B1

(12) United States Patent
James

(10) Patent No.: US 6,382,524 B1
(45) Date of Patent: May 7, 2002

(54) APPLICATOR FOR APPLYING A FLUID TO A SURFACE AND METHOD OF APPLYING A FLUID TO A SURFACE

(75) Inventor: Richard M James, Erdington (GB)

(73) Assignee: Diversey Lever, Inc., Plymouth, MI (US)

( * ) Notice: Subject to any disclaimer, the term of this patent is extended or adjusted under 35 U.S.C. 154(b) by 0 days.

(21) Appl. No.: 09/717,444

(22) Filed: Nov. 21, 2000

(30) Foreign Application Priority Data

Nov. 26, 1999 (EP) ..... 99309474

(51) Int. Cl.[7] ..... F23D 11/04

(52) U.S. Cl. ..... 239/219; 239/219; 239/220; 118/62; 118/68; 118/244; 118/253; 427/428

(58) Field of Search ..... 239/214, 219, 239/220; 118/62, 68, 244, 246, 249, 253, 261; 427/428, 429, 434.2

(56) References Cited

U.S. PATENT DOCUMENTS 1,143,385 A * 6/1915 Haberle et al.
1,983,695 A * 12/1934 Fenton
2,185,223 A * 1/1940 Paynter
2,187,421 A * 1/1940 George
2,291,046 A * 7/1942 Lange
3,626,833 A * 12/1971 Koch
3,818,859 A 6/1974 Kalmar
3,875,581 A * 4/1975 Yamashita et al.
4,155,637 A * 5/1979 Witte et al.
5,314,119 A 5/1994 Watt
6,098,691 A * 8/2000 Boldrini

FOREIGN PATENT DOCUMENTS

DE 42 23 101 C1 10/1993
DE 195 00 967 A1 7/1996
EP 0 736 329 A2 10/1996
GB 1 339 916 12/1973

* cited by examiner

*Primary Examiner*—Lesley D. Morris
*Assistant Examiner*—Robin O. Evans
(74) *Attorney, Agent, or Firm*—Edward A. Squillante, Jr.

(57) ABSTRACT

The invention pertains to an applicator for applying a fluid to a surface, comprising a frame, an applicator roller, such as a cylindrical brush, rotatably mounted in the frame, a fluid pick-up roller rotatably mounted in the frame, the pick-up roller being positioned beneath and parallel or substantially parallel to the applicator roller and in contact or near contact with the applicator roller, and a reservoir positioned beneath the pick-up roller. The applicator further comprises a skimmer, which is located parallel or substantially parallel to at least part of the pick-up roller.

9 Claims, 2 Drawing Sheets

APPLICATOR FOR APPLYING A FLUID TO A SURFACE AND METHOD OF APPLYING A FLUID TO A SURFACE

The invention pertains to an applicator for applying a fluid to a surface, comprising a frame, an applicator roller, such as an cylindrical brush, rotatably mounted in the frame, a fluid pick-up roller rotatably mounted in the frame, the pick-up roller being positioned beneath and parallel or substantially parallel to the applicator roller and in contact or near contact with the applicator roller, and a reservoir positioned beneath the pick-up roller.

Such applicators, usually denoted as non-contact thin film (NCTF) applicators, are known in the art, e.g. from U.S. Pat. No. 5,314,119, which describes an apparatus for applying a fluid to a moving web or sheet. A pick-up roller rotates within a supply pan and picks up a quantity of fluid on its surface. The fluid is subsequently transferred to a brush roller which is disposed adjacent to and in conjunction with the pick-up roller. The brush roller consists of a rotating cylinder or core with a large number of bristles extending radially outwardly therefrom and of such a length that the tips of the bristles impinge against the surface of the pick-up roller and pick-up a quantity of fluid. The bristles are twisted or bent and, after passing the centerline between the pick-up roller and the brush roller, the bristles snap forwardly and flick the fluid from the tips of the bristles away from the brush roller and against the said moving web or sheet.

Instead of using the pick-up roller for accomplishing this "flicking action", some applicators comprises an additional plate, sometimes denoted as flicker plate, mounted against the cylindrical brush, i.e. the distance between one of the edges of the plate and the rotational axis of the brush is smaller than the radius of the brush. Upon rotation, the brush picks up liquid from a reservoir via the pick-up roller and the flicker plate mounted against the brush causes the bristles in the brush the bent and, subsequently, flick the fluid away from the bristles thus generating a mist of droplets or particles of the fluid directed primarily in a direction substantially tangential to the brush at the point of contact of the flicker plate with the brush. The mist can be directed towards a surface to which the fluid is to be applied.

In many applications of such applicators, for example in those application where the fluid is relatively expensive, it is important to improve control of the dosage of the fluid and to enhance the uniformity of the distribution of the fluid.

Thus the invention aims to provide an applicator of the above-mentioned type wherein the control of the delivery of the fluid is improved.

To this end, the applicator according to the invention is characterised in that it further comprises a skimmer, which is located parallel or substantially parallel to at least part, preferably a substantial part or all of the pick-up roller.

It appeared that by skimming excess fluid from the pick-up roller, the said delivery of the fluid by the applicator can be controlled more effectively.

The applicator is further improved if the skimmer is pressed against the pick-up roller. The applied pressure should preferably be such that the thickness of the film of fluid on the pick-up roller remains substantially constant. In a preferred embodiment, the skimmer comprises two or more protrusions on the side facing the pick-up roller, which serve as spacers between the pick-up roller and the skimmer. Thus, control of the thickness of the film on the pick-up roller is further enhanced. The skimmer is preferably made of a plate-like and/or resilient material.

It is further preferred that the shape of the inner wall of the reservoir is adapted to the circumference over the pick-up roller so as to reduce the minimum volume of fluid required for operating the applicator. This embodiment is especially advantage if the applicator is used intermittently, since a reduced volume of fluid inherently results in a reduced risk of encrustation of the fluid contained in the reservoir.

The invention further pertains to a method of applying a fluid to a surface, such as a conveyor belt, floor, wall, or the like, by means of the applicator described supra and to the use of the said applicator for the application of a lubricant to the surface of a conveyor belt or for the maintenance, e.g. by applying a polish or a polish remover, of floors and the like.

The invention will be further explained by reference to the drawings in which an embodiment of the applicator according to the present invention is schematically shown.

Throughout the drawings, the same numerals are used to denoted similar parts so as to facilitate understanding of the drawings.

Figure 1:
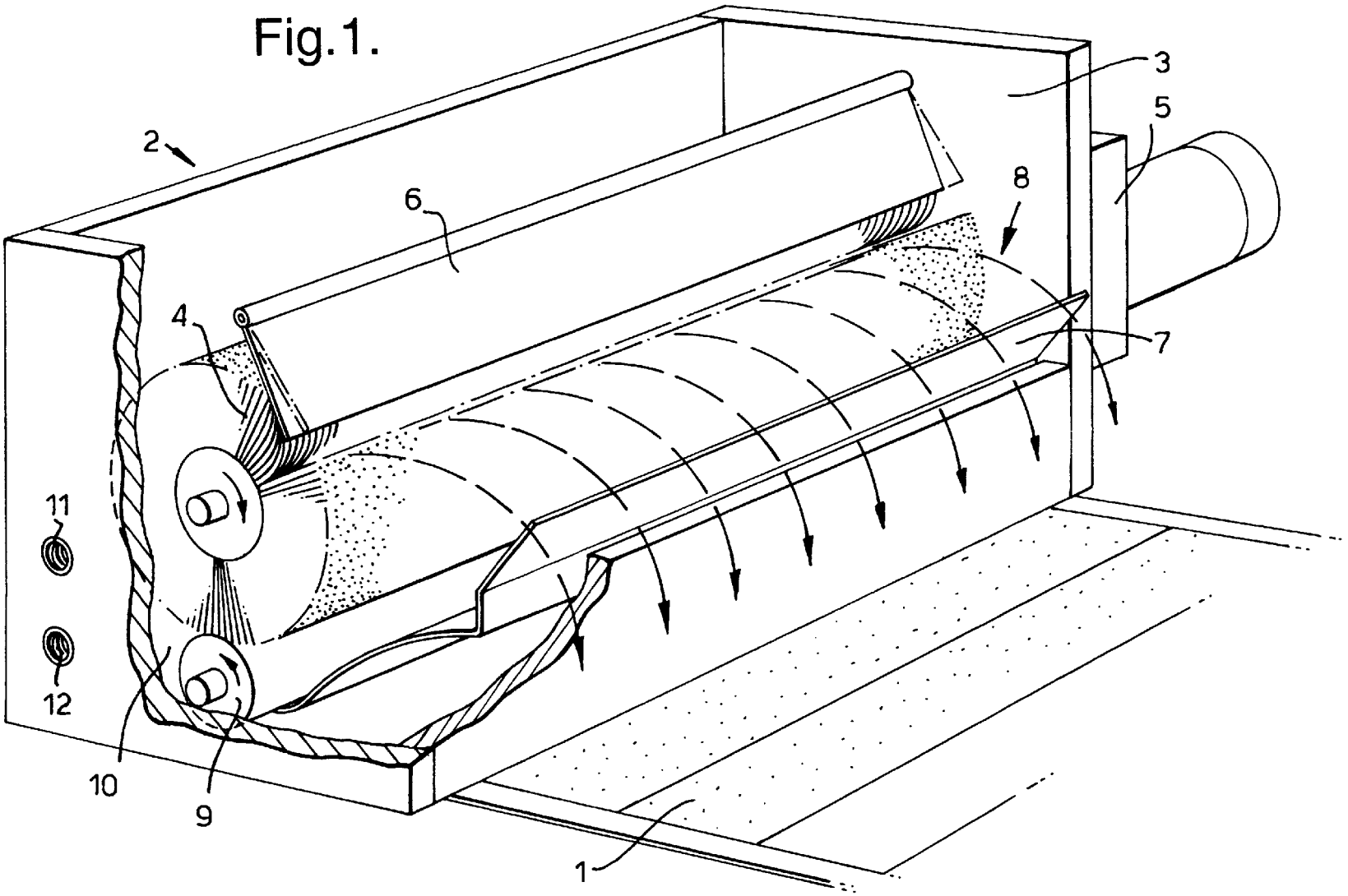
FIG. 1 shows an embodiment of the applicator according to the present invention installed on top of a conveyor belt.

FIG. 1 shows a conveyor belt 1 for the transport of glass, plastic, cardboard or metal containers such as bottles or cans. An applicator 2 is positioned on top of and transverse to the conveyor belt 1. The applicator 2 comprises a frame 3 in which a cylindrical brush 4 is rotatably mounted. The brush 4 can be driven by an electrical motor 5, but it can also be driven manually or by the means driving the conveyor belt 1 or even by the conveyor belt 1 itself. A flicker plate 6 runs parallel to the brush 4, such that the lower edge of the flicker plate 6 touches the bristles of the brush 4. Further, an anti-drip plate or baffle 7 runs parallel to the brush 4 and to the flicker plate 6, which baffle 7, in combination with the flicker plate 6, defines an elongated gap or slot 8.

A pick-up roller 9 is positioned beneath the applicator roller or brush 4, which pick-up roller 9 runs parallel to the brush 4 and has substantially the same length as the brush 4. Further, a reservoir 10 for a fluid, in this example a lubricant, that is to be applied to the surface of the conveyor belt 1 is positioned behind the baffle 7 and below the pick-up roller 9. The level in the reservoir 10 can be maintained by means of inlet opening 11 and outlet opening 12. The outlet opening 12 can be positioned at the maximum allowable level or indeed at any desirable level of fluid in the reservoir 10 so that any superfluous fluid overflows under gravity through it. Alternatively, there may be e.g. a level detector fitted in the reservoir 10 which can signal to a fluid feed pump (not shown) that it should cease feeding once a predetermined level is reached.

If the reservoir 10 contains sufficient fluid, for instance, up to the level of the lower part of the outlet opening 12, the pick-up roller 9 will, upon rotation, pick up fluid from the reservoir 10. The fluid is subsequently transferred to the rotating brush 4 at the point of (near) contact between the pick-up roller 9 and the brush 4. The flicker plate 6 will cause the bristles to bent or twist and snap forwardly, flicking the fluid away from the brush 4. Thus, a mist of droplets or particles of fluid material is generated, which mist is directed, through the slot 8, towards the conveyor belt 1 so as to coat the upper surface of the conveyor belt 1 with a thin film of the fluid.

Figure 2:
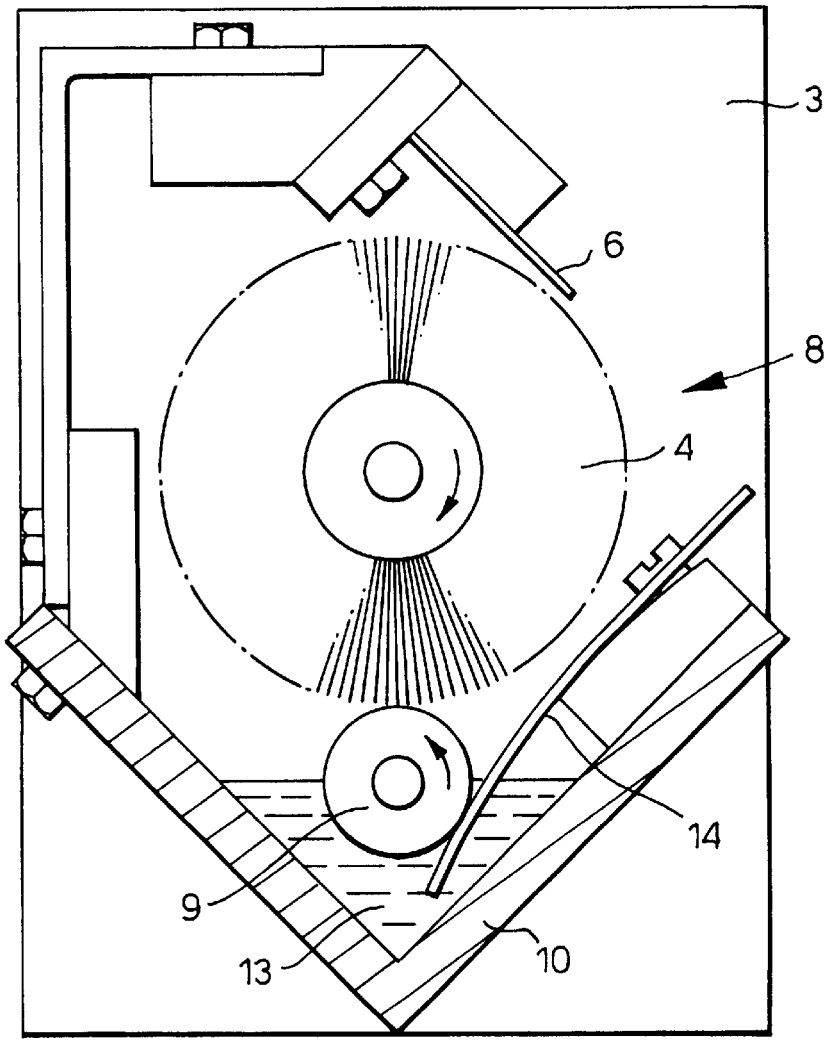
FIG. 2 shows a cross-section of an applicator similar to that shown in FIG. 1.

FIG. 2 shows a cross-section of an applicator 2 similar to that shown in FIG. 1. In this particular example the brush 4 will rotate clockwise, typically at a rotational velocity in the range from 20 to 300 revolutions per minute (RPM), so as to create a mist of droplets at the flicker plate 6.

The upper part of the pick-up roller 9 contacts the tips of the brush 4, whereas its lower part is partially immersed in the fluid 13 in the reservoir 10. The reservoir 10 is V-shaped so as to keep the volume of fluid contained therein to a minimum. The pick-up roller 9 is rotated counter-clockwise and thus picks up fluid from the reservoir 10 and transfers it to the outer surface of the brush 4.

It is preferred that, at their line of contact, the difference between the surface velocity of the brush 4 and the surface velocity of the pick-up roller 5 is zero or essentially zero. It was found that, if the surface velocities at the line of contact are substantially equal, the transfer of fluid from the pick-up roller 9 to the brush 4 is less dependent on the rheology of the fluid.

In accordance with the invention, a skimmer plate 14 is mounted on the side of the V-shaped reservoir 10 nearest the slot 8. The skimmer plate 14 is made of a resilient material and is pressed against the pick-up roller 9. The pressure exerted by the skimmer plate 11 on the pick-up roller 9 can be adjusted by means of the bolt 15 with which the skimmer plate 14 is attached to the rim of the V-shaped reservoir 10.

Instead of using a resilient skimmer plate it is also possible to use a rigid skimmer plate which is, e.g. pivotally and/or resiliently mounted above and next to the pick-up roller 9, preferably near the said slot 8. Such a rigid plate can be pressed against the pick-up roller 9 by means of a spring or by means of e.g. a counterweight.

The pressure can also be varied by use of a rotatable cam shaft contacting the skimmer plate.

Figure 3:
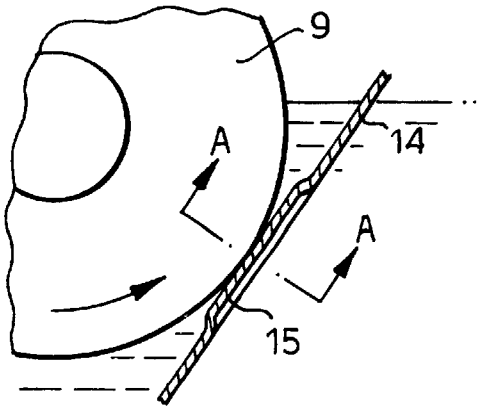
FIGS. 3 and 4 show cross-sections of one particular example of a skimmer plate suitable for use in the applicator according to FIGS. 1 and 2.
Figure 4:
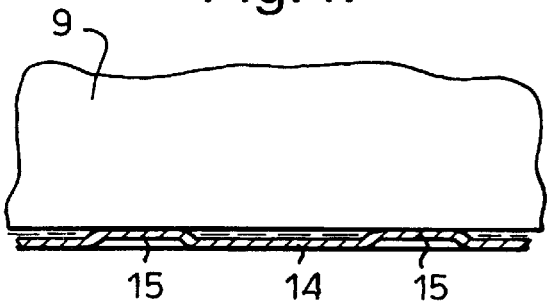

FIG. 3 shows a cross-section of a pick-up roller 9 against which an rigid skimmer plate 14 is pressed. The skimmer plate 14 is provided with indentations which form protrusions 15 on the other side of the skimmer plate 14.

These protrusions 15 serve as spacers and ensure that a predefined distance between the major part of the skimmer plate 14 and the pick-up roller 9 is maintained. This space is preferably selected substantially equal to the thickness of the film of fluid which is required on the surface of the pick-up roller 9.

Preferred lubricants are described in European patent application 99305796.7. The applicators described above may for instance dispense about 0.1 grams of liquid per second and can be run, for instance, for 5 seconds every 10 minutes. In general, the applicators according to the invention will usually deliver from 0–2, preferably from 0–1 litre per minute.

It should be noted that the invention is not limited to the use of lubricants, it may, amongst other things, be used to dispense disinfectants, polishes, polish removers, fertilisers, pesticides, herbicides, paints, powders or indeed any other fluid that can be contained in the reservoir and that can be picked-up by the mentioned pick-up roller and applicator. Further, it is also possible to move the applicator of with respect to the surface to which the fluid is to be applied instead of vice versa. For instance, the applicator according to the invention can be used in a mobile system for the maintenance of floors and the like.

Within the framework of the invention the term "fluid" is defined as any medium that, under the influence of gravity, flows to the lower part of the reservoir and that can be picked up by the mentioned pick-up roller and applicator.

Common examples of such fluids as liquids, optionally containing one or more additional phases (e.g., dispersions, suspensions or emulsions), and certain powders, for instance fluidised powders.

The invention is not restricted to the above described embodiments which can be varied in a number of ways within the scope of the invention. For instance, the width of the applicator according to invention can be readily adjusted to its use. E.g., lubrication of conveyor belts will generally required a considerable width (namely approximately equal to that of the conveyor belt), e.g. in a range from 0.5 to 2 meters, whereas the application of markings on playing fields or roads will perhaps only require a width in a range from 5 to 15 centimeters.

I claim:

1. An applicator (2) for applying a fluid to a surface (1), comprising a frame (3), an applicator roller (4) rotatably mounted in the frame (3), a fluid pick-up roller (9) rotatably mounted in the frame (3), the pick-up roller (9) being positioned beneath and substantially parallel to the applicator roller (4) and in contact with the applicator roller (4), and a reservoir (10) positioned beneath the pick-up roller (9), the applicator (2) further comprising a skimmer (14), which is located substantially parallel to at least part of the pick-up roller (9)

wherein the skimmer 14 comprises two or more protrusions (15) on the side facing the pick-up roller (9).

2. The applicator (2) according to claim 1, wherein the skimmer (14) is pressed against the pick-up roller (9).

3. The applicator (2) according to claim 1, wherein the skimmer (14) is made of a resilient material.

4. The applicator (2) according to claim 1, wherein a flicker plate (6) is mounted against the applicator roller (4).

5. The applicator (2) according to claim 1, wherein the shape of the inner wall of the reservoir (10) is adapted to the circumference of the pick-up roller (9) so as to reduce the minimum volume of fluid required for operating the applicator (2).

6. A method of applying a fluid to a surface, by applying fluid to the surface with an applicator (2) having a frame (3), an applicator roller (4) rotatably mounted in the frame (3), a fluid pick-up roller (9) rotatably mounted in the frame (3), the pick-up roller (9) being positioned beneath and substantially parallel to the applicator roller (4) and in contact with the applicator roller (4), a reservoir(10) positioned beneath the pick-up roller (9), and a skimmer (14), which is located substantially parallel to at least part of the pick-up roller (9)

wherein the skimmer 14 comprises two or more protrusions (15) on the side facing the pick-up roller (9).

7. The method according to claim 6, wherein the surface velocity of the applicator roller (4) is equal or substantially equal to the surface velocity of the pick-up roller (9).

8. The method according to claim 6, wherein the level of fluid in the reservoir (10) is such that the point or line of contact between the pick-up roller (9) and the skimmer (14) is immersed.

9. The method according to claim 6, wherein the fluid comprises a lubricant, a disinfectant and/or a cleaning agent.

* * * * *